US009643234B2

(12) United States Patent
Suto

(10) Patent No.: US 9,643,234 B2
(45) Date of Patent: May 9, 2017

(54) ROLLER CLAMP FOR WIRE PROCESSING

(71) Applicant: Automated Industrial Machinery, Inc., Addison, IL (US)

(72) Inventor: Tony Suto, Elburn, IL (US)

(73) Assignee: Automated Industrial Machinery, Inc., Addison, IL (US)

( * ) Notice: Subject to any disclaimer, the term of this patent is extended or adjusted under 35 U.S.C. 154(b) by 315 days.

(21) Appl. No.: 14/452,236

(22) Filed: Aug. 5, 2014

(65) Prior Publication Data

US 2015/0040637 A1 Feb. 12, 2015

Related U.S. Application Data

(60) Provisional application No. 61/862,828, filed on Aug. 6, 2013.

(51) Int. Cl.
*B21F 1/00* (2006.01)
*B21F 23/00* (2006.01)

(52) U.S. Cl.
CPC ..... *B21F 1/00* (2013.01); *B21F 23/005* (2013.01)

(58) Field of Classification Search
CPC ..... B21D 43/006; B21D 43/08; B21F 1/008; B21F 23/002; B21F 23/005; B23Q 7/02; B23Q 7/04; B23Q 7/05
See application file for complete search history.

(56) References Cited

U.S. PATENT DOCUMENTS 1,887,434 A 11/1932 Sammis
2,538,950 A 1/1951 Schryber
2,680,607 A 6/1954 Hollinger
3,245,433 A 4/1966 Taylor, Jr.
3,278,060 A 10/1966 Cooper
3,667,634 A 6/1972 Potterat
4,546,681 A 10/1985 Owsen
4,650,237 A 3/1987 Lessway
5,291,771 A 3/1994 Tomo et al.
5,556,085 A 9/1996 Cyr
6,082,168 A 7/2000 Kosch
6,230,535 B1 5/2001 Benes et al.
6,341,517 B2 1/2002 Benes et al.
6,458,022 B1 10/2002 Folz
8,266,992 B2 9/2012 Rehm
2007/0256468 A1* 11/2007 Pang ..... B21D 43/006 72/336
2013/0180307 A1 7/2013 Mitze

* cited by examiner

*Primary Examiner* — Debra Sullivan

(74) *Attorney, Agent, or Firm* — Fitch, Even, Tabin & Flannery LLP

(57) ABSTRACT

A roller clamping apparatus is provided that includes a first jaw and a second jaw configured to move relative to each other between an open position and a closed position. The jaws include at least one drive roller supported by the first jaw and configured to rotate a round wire having a longitudinal axis. The apparatus further includes at least one support element supported by the second jaw. When the jaws are in a closed position, the drive roller and the support rollers tangentially contact an outside surface of the wire. The support element is positioned to make contact with the wire across the longitudinal axis of the wire when the wire is secured within the clamping apparatus. Mechanisms and methods that use the roller clamping apparatus are also disclosed.

16 Claims, 6 Drawing Sheets

ROLLER CLAMP FOR WIRE PROCESSING

CROSS REFERENCE TO RELATED APPLICATIONS

This application claims the benefit of prior U.S. Provisional Patent Application No. 61/862,828, filed on Aug. 6, 2013, which application is incorporated by reference in its entirety as though fully rewritten herein.

TECHNICAL FIELD

The invention relates generally to a mechanism for fixturing and manipulating a wire, and more specifically, to such devices associated with wire bending machinery.

BACKGROUND

A number of mechanisms are known for fixturing wires during bending operations. The prior art includes hydraulic mechanisms for clamping wires within a bending machine. These mechanisms relied upon jaws that closed on the wires and held the wires fixed within the clamp. In these mechanisms, the jaws clamp the wire with a force that prevents the wire from rotating relative to the jaws. In applications that require a wire to be rotated, the known clamps themselves must be rotated to rotate a wire about its longitudinal axis. The jaws exert a force on the wires, and static friction between the jaws and the clamps holds the wires fixed as the clamping mechanism itself is rotated.

In wire bending machines, the desire is to make the clamping mechanism as narrow as possible so that the wire can be bent as close as possible to the clamp itself. The need therefore is to make the clamping mechanism and its supporting elements as narrow as possible. Further, since the entire mechanism including jaws must be rotated, the clamping mechanism must be designed as compactly as possible. Hydraulic systems are the preferred method of generating the mechanical advantage required by such clamps, while keeping the mechanism itself compact.

The known hydraulic clamping mechanisms have several undesirable limitations. First, the known mechanisms have seals that wear out over time and are difficult to replace. As discussed above, the jaws of the known hydraulic clamps must rotate to rotate a wire. The known mechanisms have seals that transmit hydraulic fluid from the stationary part of the mechanism to the rotating part of the mechanism. These seals are prone to mechanical wear. When the seals wear out, they must be replaced. Replacing the seals requires machine downtime and is complicated because the seals must be carefully installed. Contamination is a problem, both during replacement and during ordinary operation of the mechanisms. The known seals are subject to contamination with debris common in manufacturing facilities, including metallic particles, grit, oil, and other damaging foreign material.

Second, the known hydraulic clamping mechanisms have a limited range of motion. The same seals that transmit hydraulic fluid from the stationary part of the mechanism to the rotating part of the mechanism also limit the range of motion for the mechanisms. Known hydraulic clamping mechanisms are typically limited to approximately 250 degrees of rotation.

Third, the known hydraulic clamping mechanisms have hoses and other appendages that make them wider than is frequently desired. A mechanism that is narrower than the known mechanisms is desired, as this increases the flexibility of machines that incorporate such wire clamping mechanisms.

SUMMARY

Generally speaking and pursuant to these various embodiments, a clamping apparatus is provided that includes a first jaw and a second jaw configured to move relative to each other between an open position and a closed position. The jaws include at least one drive roller supported by the first jaw and configured to rotate a round wire having a longitudinal axis. The drive roller makes tangential contact on an outside surface of the wire when the first jaw is in the closed position relative to the second jaw. The apparatus further includes at least one support element configured to make tangential contact with the outside surface of the wire when the first jaw and the second jaw are in the closed position. The support element is positioned to make contact with the wire across the longitudinal axis of the wire when the wire is present within the clamping apparatus and the first jaw is in the closed position relative to the second jaw.

The use of rollers making tangential contact with the wire makes it possible to rotate the wire by driving the drive roller. Thus, the wire is rotated relative to the jaws, rather than holding the wire fixed relative to the jaws and rotating the jaws that comprise the clamping mechanism. Because the entire mechanism no longer needs to be rotated, the clamping force may be generated through simple mechanical advantage over a long lever arm. This eliminates the need for complicated hydraulic systems and the seals found in the known clamping mechanisms. Advantageously, because the wire is rotated relative to the jaws, the wire may be rotated through an infinite range of motion.

In one described example, the clamping apparatus further includes support rollers. At least one of the support rollers is supported by the second jaw. The support rollers are positioned within the apparatus such that they are configured to clamp the round wire through tangential contact with the outside surface of the wire when the first jaw is in the closed position relative to the second jaw. In a further described example, the clamping apparatus further includes a drive mechanism coupled to the at least one drive roller. The drive mechanism is configured to rotate the drive roller. In a further described example, the clamping apparatus further includes a clamping actuator mechanically coupled to the first jaw and the second jaw and configured to actuate the first jaw and the second jaw between the open position and the closed position.

A further described example of the clamping apparatus includes a cartridge body removably secured to the second jaw. The at least one support element is supported by the cartridge body. This removable cartridge facilitates clamping different sized wires. Larger wires, for example, tend to require different sized support rollers in the described examples that include support rollers. Larger wires might also, in such examples, require the support rollers in such examples to be positioned differently relative to one another.

The clamping apparatus described generally in the examples above may also, in a further described example, be incorporated in a wire bending apparatus that further includes at least one wire bending head configured to traverse a path along the length of the wire. In such a wire bending apparatus, the bending head is configured to bend the wire. A further described example of the wire bending apparatus includes a wire loading mechanism configured to position a wire between the first jaw and the second jaw when the first jaw is in the opened position relative to the second jaw.

The clamping apparatus described generally in the examples above may also, in further described examples, be used in a method of machining a wire including securing a wire within a clamping mechanism comprising at least one drive roller configured to contact the wire at a point on the outside surface of the wire. The method further includes bending the wire at a first predetermined position along the length of the wire using a wire bending head configured to traverse a path along the length of the wire. The method further includes rotating the wire within the clamping mechanism through a predetermined angle of rotation, by rotating the drive roller. The method further includes bending the wire at a second predetermined position along the length of the wire using the wire bending head. A further described example of the method of machining a wire may include rotating the wire within the clamping mechanism through a predetermined angle of rotation that may exceed 360 degrees.

BRIEF DESCRIPTION OF THE DRAWINGS

The above needs are at least partially met through provision of a roller clamp described in the following detailed description, particularly when studied in conjunction with the drawings, wherein.

Figure 1:
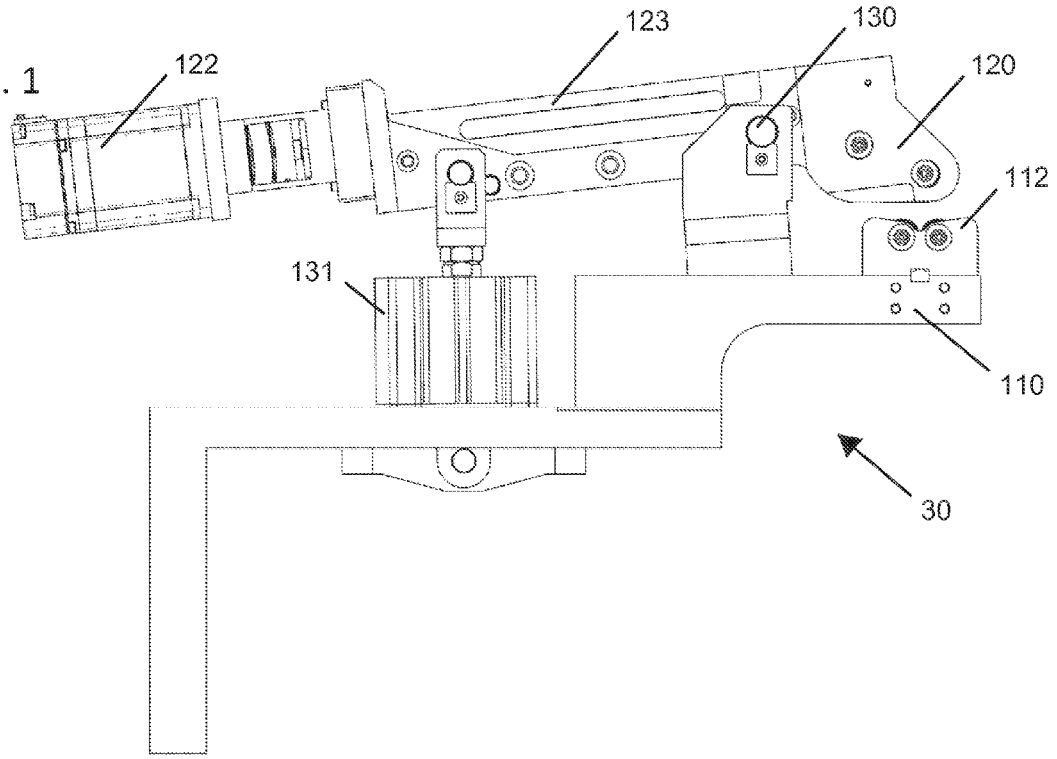
FIG. 1 comprises a side view of a roller clamping apparatus, shown with a clamp in an open position.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will also be understood that the terms and expressions used herein have the ordinary technical meaning as is accorded to such terms and expressions by persons skilled in the technical field as set forth above except where different specific meanings have otherwise been set forth herein. Like numbered elements described herein and illustrated in the drawing figures will be understood to describe the same feature, regardless of the drawing figures in which they appear.

DETAILED DESCRIPTION

In one embodiment, the clamping apparatus is a unit within a steel wire bending machine. Such wire bending machines are capable of forming a variety of wire sizes. The cross-sectional profile of the wire used with the clamping apparatus is substantially circular. FIG. 11 illustrates an example of a wire bending machine 10 with two wire bending heads 20. A roller clamping apparatus 30 is positioned between the wire bending heads 20. The roller clamping apparatus 30 holds a wire (not shown in FIG. 11) to be formed by the bending heads 20. The wire bending machine 10 further includes a wire loading mechanism 40. The wire loading mechanism 40 grasps the wire and places it between two jaws (e.g., 110 and 120 illustrated in FIGS. 1-10) of the clamping apparatus when the clamping apparatus is in an open position. The two jaws of the roller clamping apparatus 30 are driven to a closed position to secure the wire. In addition to securing the wire, the clamping apparatus 30 is capable of rotating the wire around its longitudinal centerline. By bending a wire using a bending head (e.g, 20), then rotating the wire, then bending the wire again at a second location using the same bending head (e.g, 20), the straight wire can be bent into a variety of three-dimensional shapes.

Figure 2:
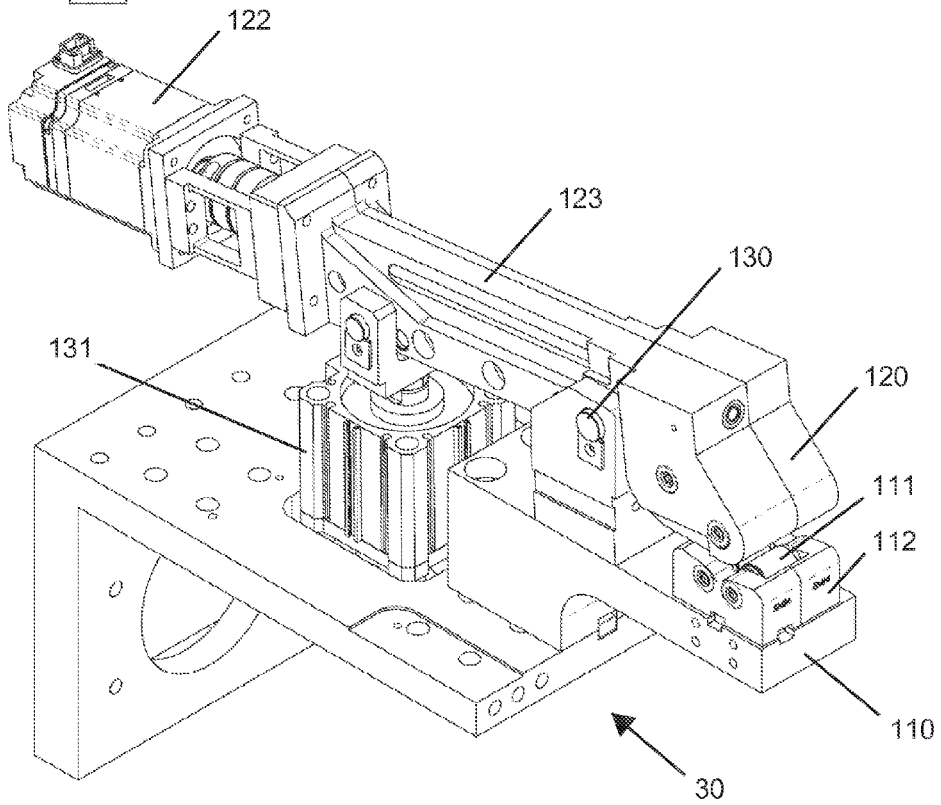
FIG. 2 comprises a perspective view of a roller clamping apparatus, shown with a clamp in an open position.

FIG. 1 illustrates an example of a roller clamping apparatus 30. The apparatus includes a top jaw 120 and a bottom jaw 110. A drive roller 121 (illustrated for example in FIG. 6) is supported in the top jaw 120. An electric servo-motor 122 rotates the drive roller 121. The electric servo-motor 122 is mounted at the rear of a lever arm 123 attached to the top jaw 120. Two support rollers 111 (illustrated for example in FIG. 2) are supported in the bottom jaw 110. The support rollers 111 are configured to rotate with minimal resistance. In alternative embodiments of a roller clamping apparatus, a drive roller may be supported by the lower jaw 110. Further alternative embodiments may include additional drive rollers and more or fewer support rollers. The top jaw is pivotally mounted to a fulcrum 130 that extends upwards from the bottom jaw 110. A lever arm 123 extending away from the top jaw is connected to a pneumatic cylinder 131 capable of advancing and retracting. This advancing and retracting of the pneumatic cylinder 131 acts respectively to close and open the jaws. The force exerted by the pneumatic cylinder 131 acts as a clamping force when a wire 50 is loaded in the roller clamping apparatus. FIG. 2 further illustrates the elements of the roller clamping apparatus 30 of FIG. 1.

Figure 3:
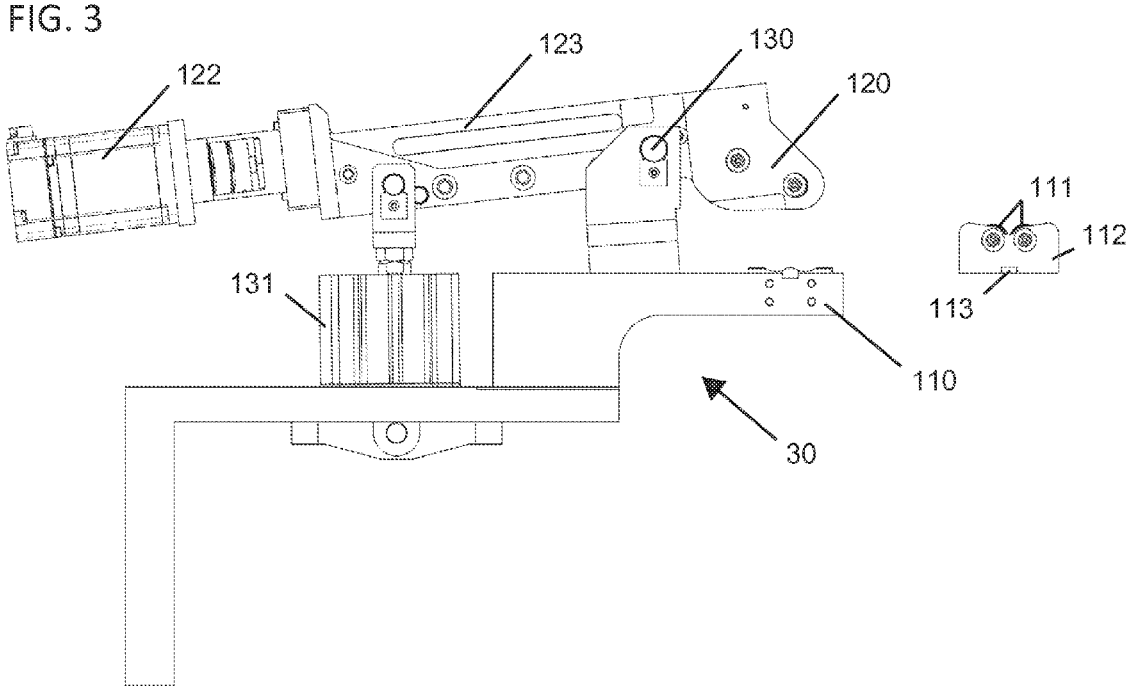
FIG. 3 comprises a side view of a roller clamping apparatus, shown with a clamp in an open position and with a support roller cartridge removed from a roller clamping apparatus.
Figure 4:
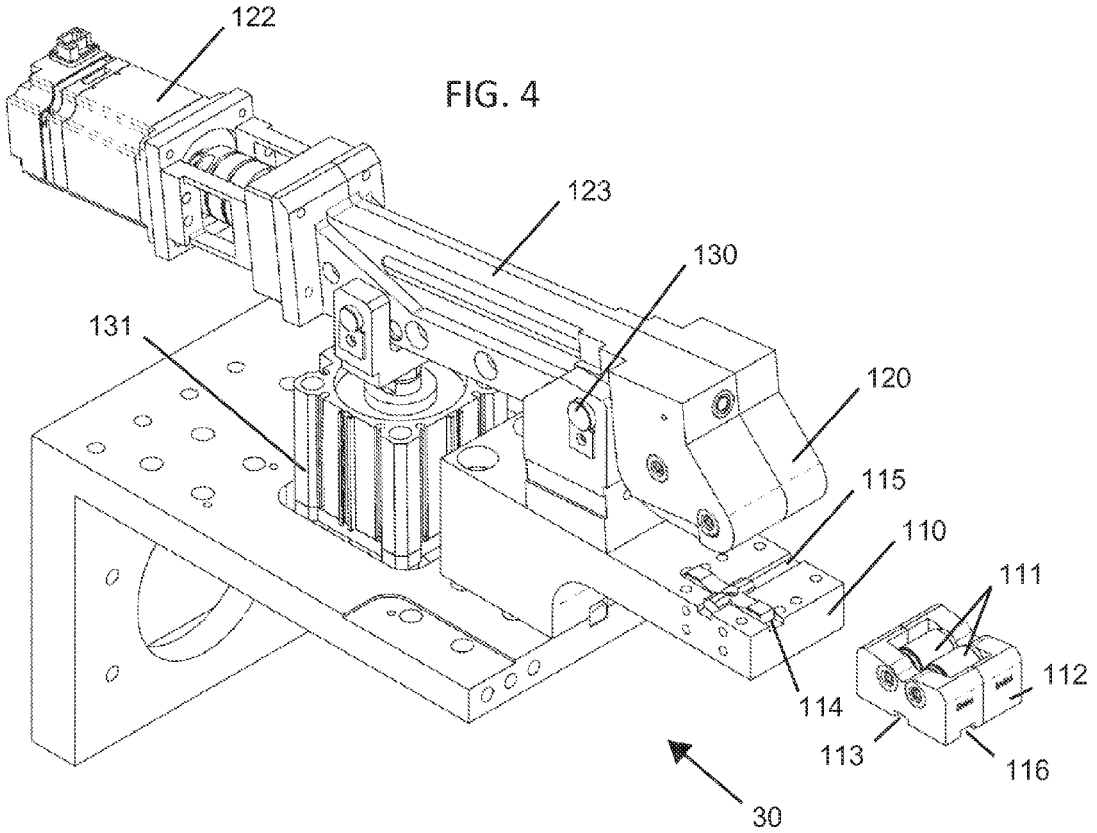
FIG. 4 comprises a perspective view of a roller clamping apparatus, shown with a clamp in an open position and with a support roller cartridge removed from a roller clamping apparatus.

FIG. 3 and FIG. 4 illustrate a removable cartridge 112 designed to mount on the lower jaw 110 of a roller clamping apparatus 30. FIG. 3 and FIG. 4 illustrate the cartridge 112 separate from the roller clamping apparatus 30. The cartridge 112 includes two support rollers 111 described above with respect to FIG. 1. By replacing the cartridge 112, different sized wires (e.g., 50) can be accommodated by the roller clamping apparatus 30. For example, wires with larger diameters may require support rollers (e.g., 111) that are mounted closer to the lower jaw 110. Alternatively, a cartridge for larger wires may use support rollers with smaller diameters.

Figure 5:
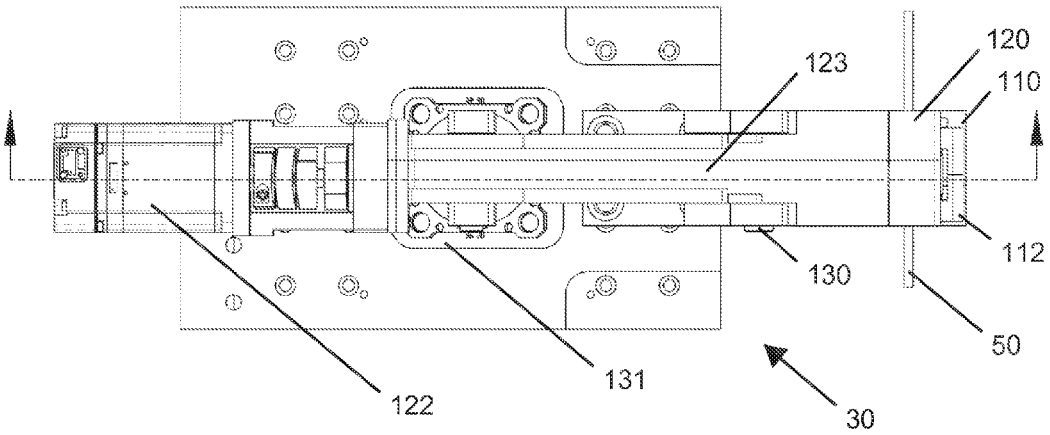
FIG. 5 comprises a top view of a roller clamping apparatus, shown with a line to indicate the cross-sectional view illustrated in FIG. 6.
Figure 6:
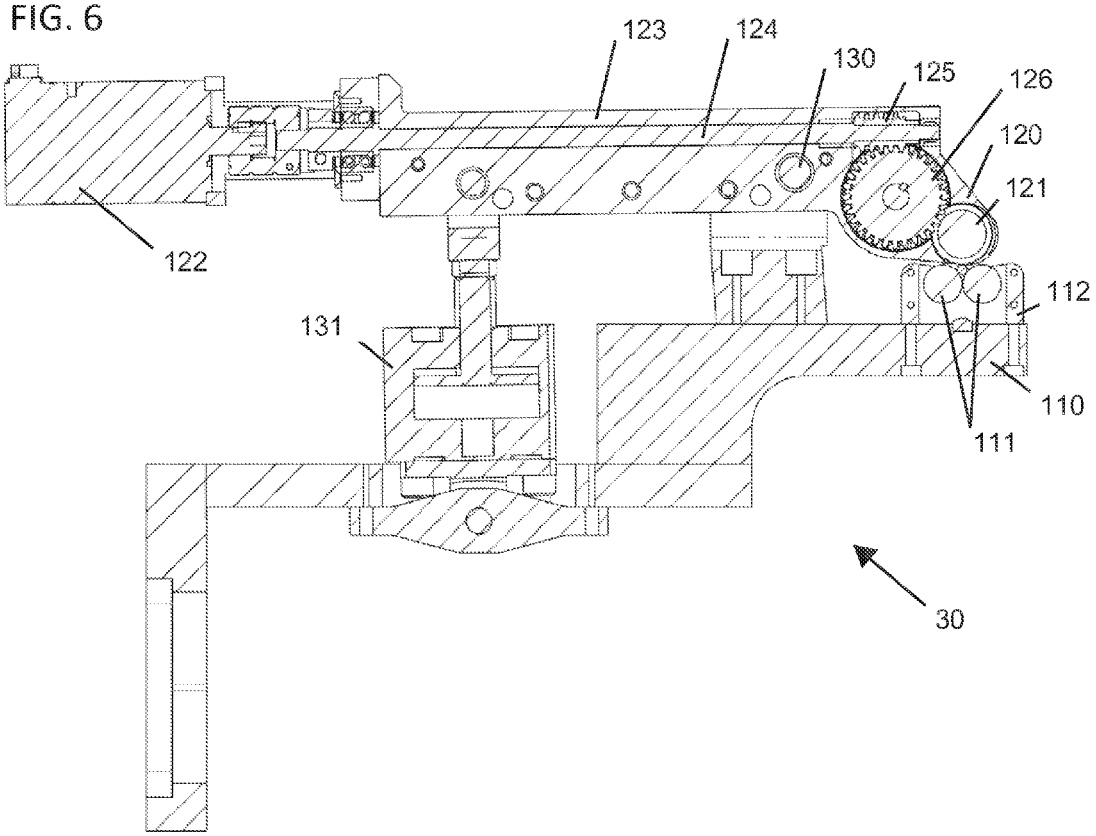
FIG. 6 comprises a cross-sectional view of a roller clamping apparatus.

FIG. 5 and FIG. 6 further illustrate the mechanism that causes the drive roller to rotate. As illustrated in FIG. 6, the electric servo-motor 122 is connected to a shaft 124 extending through the length of a lever arm 123 that connects to the upper jaw 120. A worm gear 125 is mounted to the end of the shaft 124. The worm gear 125 interfaces with a spur gear 126 mounted within the upper jaw 120. The spur gear 126 interfaces with the drive roller 121. Through this mechanism, the drive roller 121 rotates in response to rotation of the electric servo-motor 122. In alternative examples of a roller clamping apparatus 30, one or more of the support rollers (e.g., 111) could be a drive roller configured to rotate the wire, if a similar mechanism were provided to drive the one or more of the support rollers.

As illustrated in FIG. 6, a roller clamping apparatus secures a wire 50 between a drive roller 121 and two support rollers 111. The support rollers 111 oppose the clamping force exerted through the drive roller 121. As illustrated in FIG. 6, the support rollers 111 are positioned on the opposite side of the wire 50 from the drive roller 121. The clamping force exerted by a pneumatic cylinder 131 allows the drive roller 121 to rotate the wire 50. Each of the drive roller 121 and the support rollers 111 contacts the wire tangentially to the surface of the wire 50. Since each of the rollers 121, 111 and the wire 50 are substantially cylindrical, the drive roller 121 causes the wire 50 to rotate in response to rotation of the drive roller 121. The wire 50 causes the support rollers 111 to rotate in response to rotation of the wire 50.

In alternative examples, a support roller (e.g., 111) could be supported by the top jaw 120, alongside the drive roller 121. In that example, the support roller would still serve to oppose the clamping force exerted by the drive roller. In most examples of a roller clamping apparatus, the wire will be supported by at least three separate points of contact, each point of contact located along a separate radius that begins at the center of the wire. Preferably, each of the points of contact will be a roller so that the wire can easily be rotated. A roller clamping apparatus may include more or fewer rollers, as required to lock the wire within the mechanism and generate the forces necessary to rotate a wire when the wire is secured within the clamping apparatus.

Figure 8:
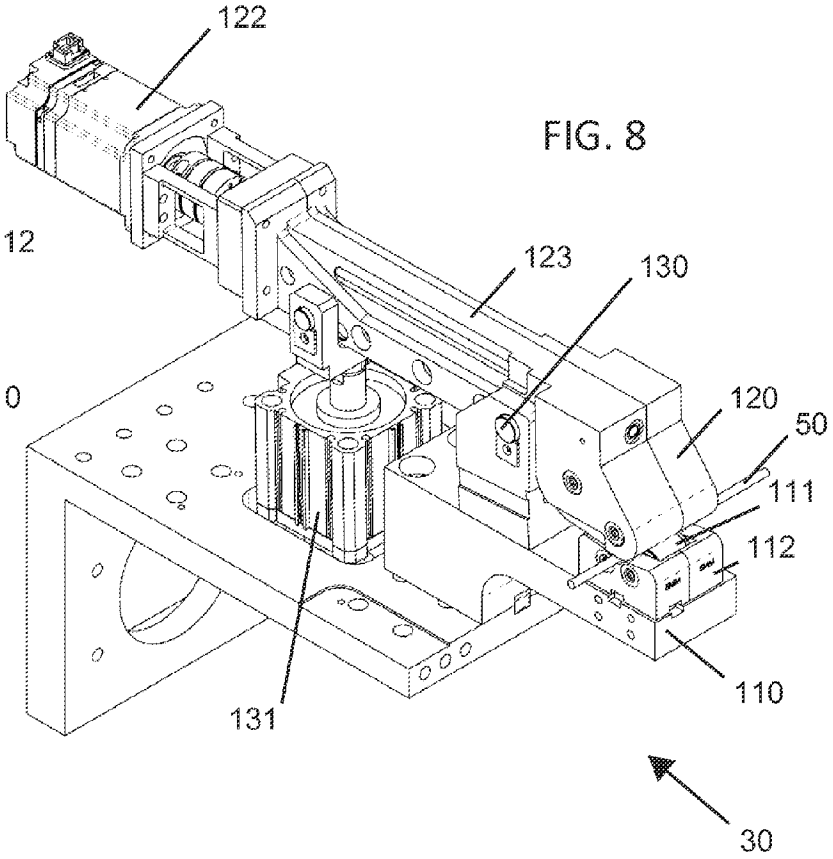
FIG. 8 comprises a perspective view of a roller clamping apparatus, shown with a clamp in a closed position and holding a wire.
Figure 7:
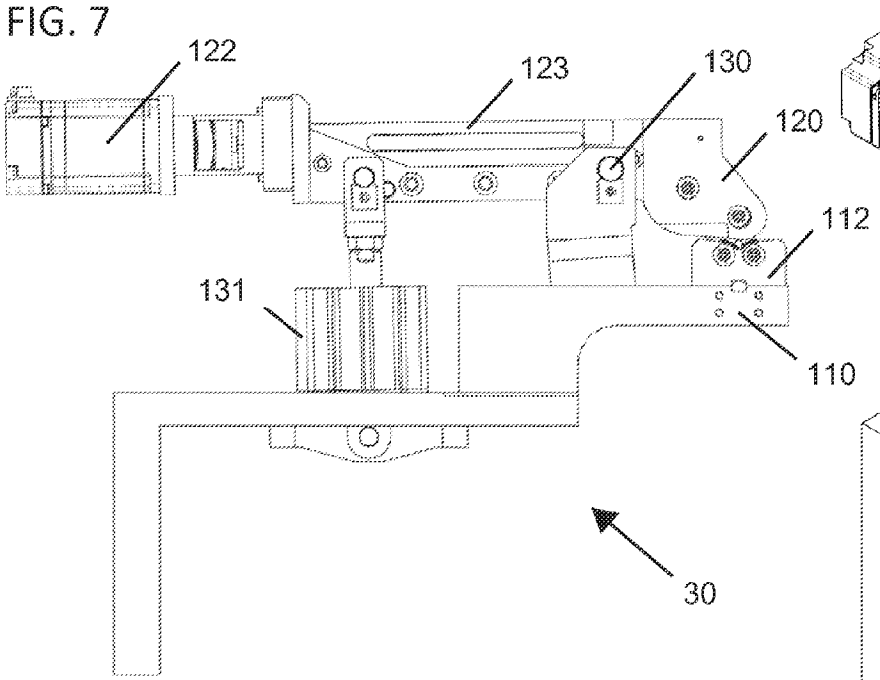
FIG. 7 comprises a side view of a roller clamping apparatus, shown with a clamp in a closed position and holding a wire.

FIG. 7 and FIG. 8 further illustrate a roller clamping apparatus 30 in a closed position. When the pneumatic cylinder 131 is advanced as illustrated, a lever arm 123 attached to the cylinder 131 drives a top jaw 120 to the closed position, as shown.

Figure 9:
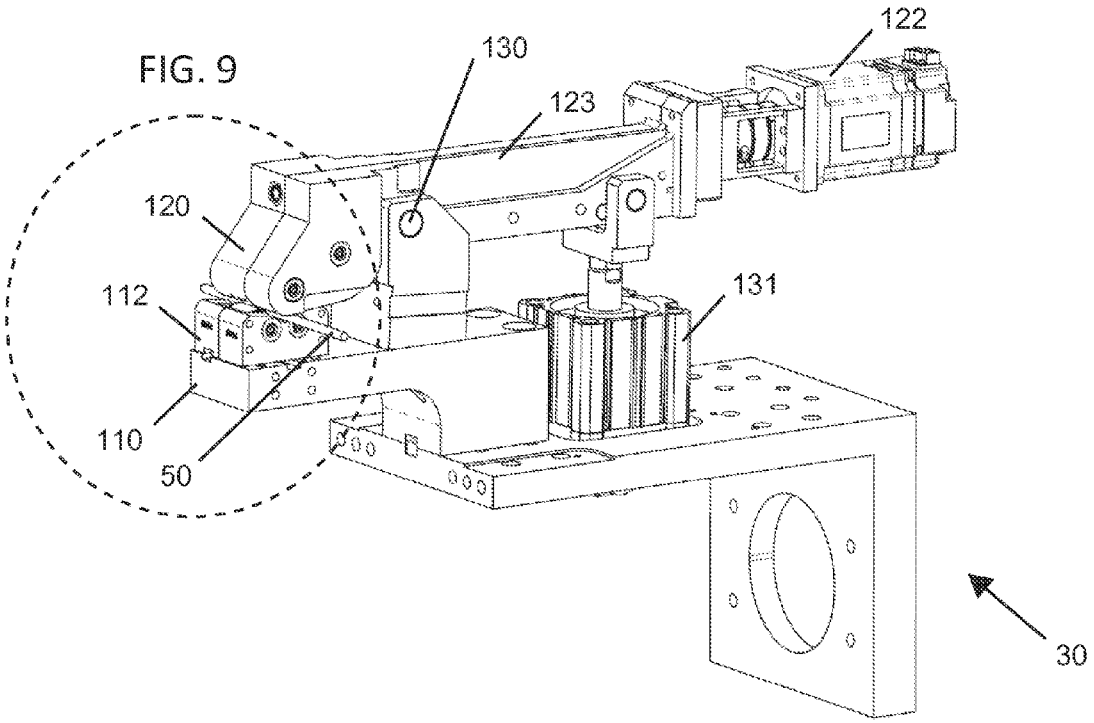
FIG. 9 comprises a perspective view of a roller clamping apparatus, shown with a clamp in a closed position and holding a wire, and shown with a circle to indicate the portion of the apparatus illustrated in FIG. 10.
Figure 10:
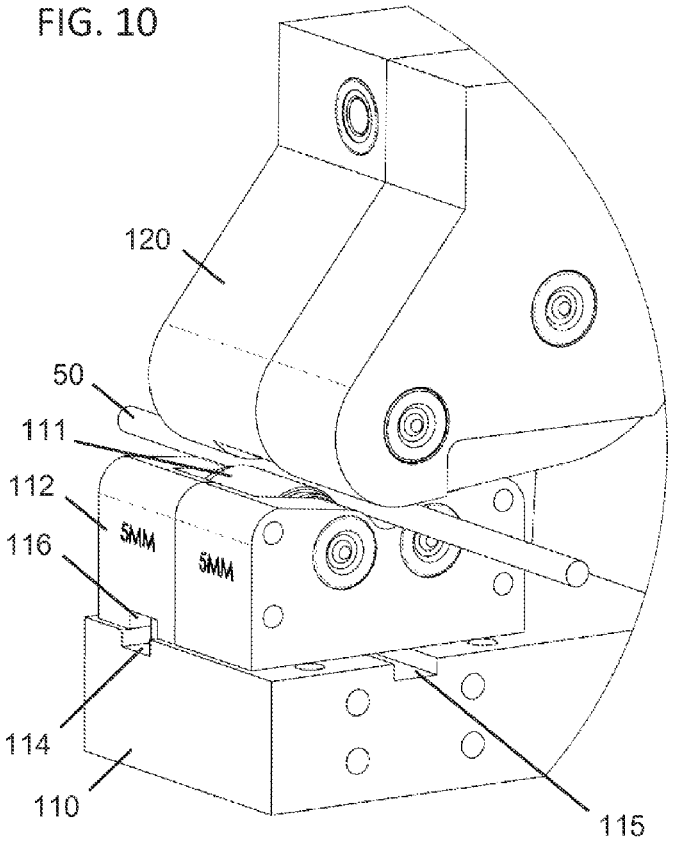
FIG. 10 comprises a close-up perspective view of a roller clamping apparatus, shown with a clamp in a closed position and holding a wire.
Figure 11:
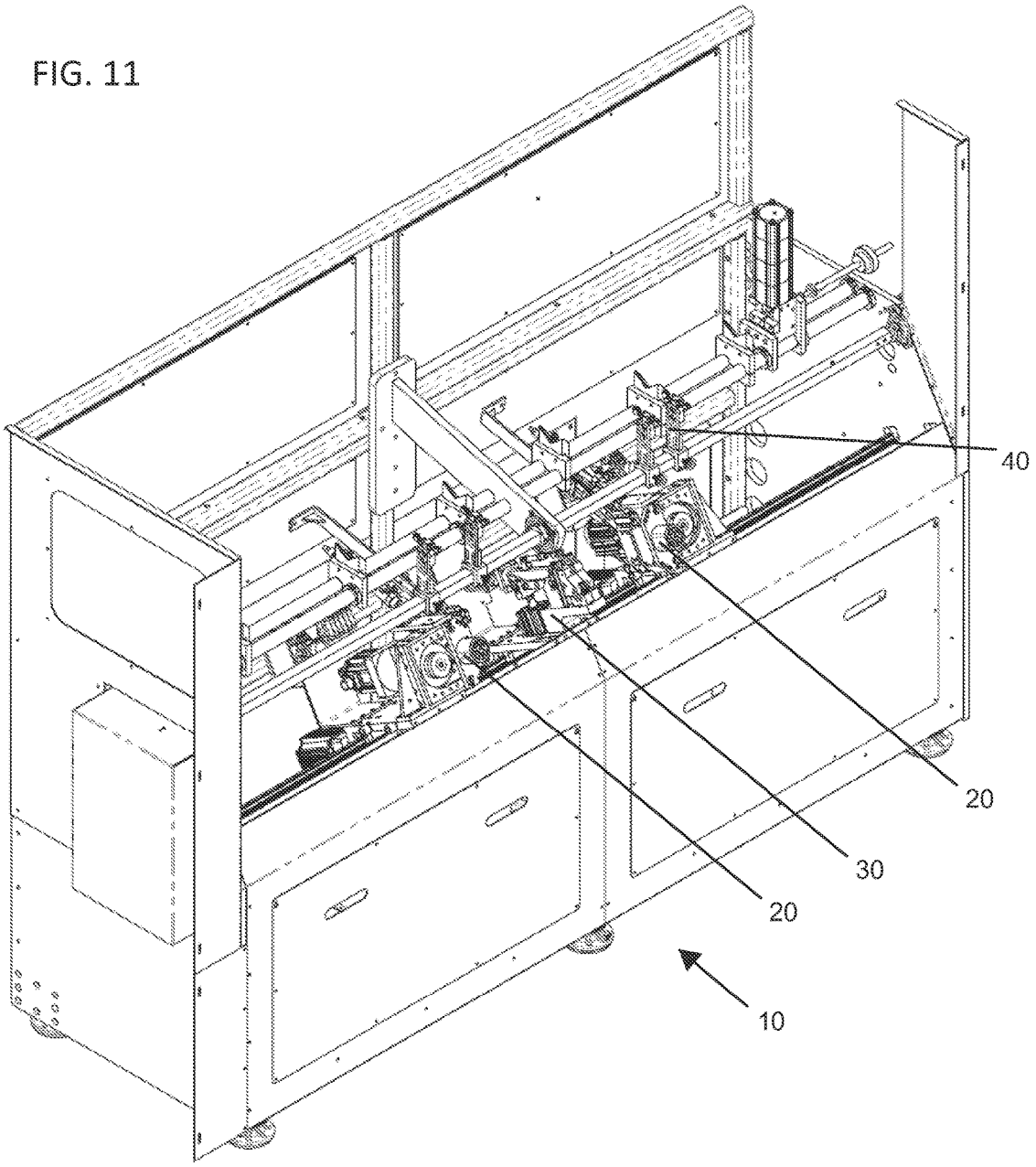
FIG. 11 comprises a perspective view of a wire bending apparatus.

FIG. 9 and FIG. 10 illustrate a close-up view of a roller clamping apparatus 30. As shown in FIG. 10, at least one keyway 114 and 115 in the lower jaw 110 is used to align the removable cartridge 112 to the lower jaw 110 via at least one corresponding keyway 113 and/or 116 in the cartridge 112. The lower jaw 110 as illustrated in FIG. 10 includes a keyway 115 parallel to the wire 50, and a second keyway 114 perpendicular to the wire 50.

In operation, a roller clamping apparatus 30 may be part of a larger wire bending machine 10, as illustrated in FIG. 11. As described, the clamping apparatus 30 secures a wire so that one or more bending heads 20 within the wire bending machine can bend the wire. The wire bending heads traverse a path parallel to a straight wire when that wire is held in the roller clamping apparatus 30. In a preferred example of the wire bending machine 10, the bending heads 20 and the clamping apparatus 30 are all moved using servo-motors under control of a programmable processor. By configuring the processor with appropriate software, the bending heads 20 can be driven to a preselected location along the wire. In alternative examples, other mechanisms could repeatably position the bending heads along the length of a wire held by the roller clamping apparatus.

As described above, a drive roller 121 of the roller clamping apparatus is rotated in response to rotation of a servo-motor 122. This drive roller servo-motor 122 is preferably under control of the same programmable processor that controls the position of bending head 20 and roller clamping apparatus 30. By configuring the processor with appropriate instructions (using, for example, corresponding software), the drive roller 121 and the wire can be rotated to a specified angle either before or after a bending head 20 bends the wire. It will further be appreciated that these actions and/or steps may occur in a different order.

To rotate the wire through a selected angle of rotation, the software instructions can incorporate the gear ratio between the drive roller servo-motor and the drive roller. The software instructions may also incorporate the ratio of the diameter of the drive roller relative to the diameter of the wire held by the roller clamping apparatus. By multiplying the gear ratio and the roller-wire diameter ratio by the desired angle of rotation, the software instructions can calculate the angle of rotation to command the servo-motor 122.

The roller clamping apparatus is capable of rotating the wire without limit to the range of rotation. Thus, a single rotation command may exceed 360 degrees of wire rotation in a given direction. Alternatively, a series of rotation commands may add up to exceed 360 degrees of rotation in a given direction. This reduces the cycle time for parts that require multiple bends at wire rotations beyond one complete revolution of the wire. In the devices previously known in the art it was necessary to work within the limited range of rotation available in the clamping mechanisms.

For parts with multiple rotation commands that add up to exceed 360 degrees, it was previously necessary to program long reverse rotation commands. For example, on a prior art apparatus with a 360 degree range of motion, if the wire required four bends at rotations separated by 100 degrees, the wire had to be rotated as follows: three moves of 100 degrees clockwise, then a fourth move of 260 degrees counter-clockwise. This long reverse rotation required longer cycle-times than would be necessary if the wire needed only to be rotated 100 degrees clockwise. As illustrated by this example, the roller clamping apparatus disclosed herein is advantageous because it is capable of rotating the wire through a range that exceeds 360 degrees without requiring any such reverse rotations. Because the wire is rotated relative to the clamping mechanism, the wire rotation has no finite limit. In contrast, in known prior art mechanisms, the range of motion was typically limited to approximately 250 degrees of rotation. On these mechanisms, reverse rotation was even more likely to be necessary.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A clamping apparatus comprising:

a first jaw and a second jaw pivotally joined to one another through a fulcrum shaft and configured to move relative to each other between an open position and a closed position;

at least one drive roller supported by the first jaw and configured to rotate a round wire having a longitudinal axis through tangential contact of the at least one drive roller on an outside surface of the wire when the first jaw is in the closed position relative to the second jaw;

at least one support element configured to make tangential contact with the outside surface of the wire when the first jaw and the second jaw are in the closed position, the at least one support element positioned to make contact with the wire across the longitudinal axis of the wire from the at least one drive roller when the wire is present within the clamping apparatus and the first jaw is in the closed position relative to the second jaw.

2. The clamping apparatus of claim 1, the at least one support element further comprising two or more support rollers wherein at least one of the support rollers is supported by the second jaw, the support rollers positioned within the apparatus such that they are configured to clamp the round wire through tangential contact with the outside surface of the wire when the first jaw is in the closed position relative to the second jaw.

3. The clamping apparatus of claim 1, further comprising a drive mechanism coupled to the at least one drive roller, configured to rotate the at least one drive roller.

4. The clamping apparatus of claim 1, further comprising a clamping actuator mechanically coupled to the first jaw and the second jaw and configured to drive the first jaw and the second jaw between the open position and the closed position.

5. A clamping apparatus comprising:

a first jaw and a second jaw configured to move relative to each other between an open position and a closed position, at least one drive roller supported by the first jaw and configured to rotate a round wire having a longitudinal axis through tangential contact of the at least one drive roller on an outside surface of the wire when the first jaw is in the closed position relative to the second jaw, at least one support element configured to make tangential contact with the outside surface of the wire when the first jaw and the second jaw are in the closed position, the at least one support element positioned to make contact with the wire across the longitudinal axis of the wire when the wire is present within the clamping apparatus and the first jaw is in the closed position relative to the second jaw; and a cartridge body removably secured to the second jaw wherein the at least one support element is supported by the cartridge body.

6. A wire bending apparatus comprising:

a clamping apparatus configured to secure a wire relative to the wire bending apparatus, the clamping apparatus further comprising:

a first jaw and a second jaw pivotally joined to one another through a fulcrum shaft and configured to move relative to each other between an open position and a closed position;

at least one drive roller supported by the first jaw and configured to tangentially contact the wire on the outside surface of the wire when the first jaw and the second jaw are in the closed position, the at least one drive roller also configured to rotate the wire about an axis parallel to the length of the wire;

at least one support element configured to make tangential contact with the outside surface of the wire when the first jaw and the second jaw are in the closed position, the at least one support element positioned to make contact with the wire across the longitudinal axis of the wire from the at least one drive roller when the wire is present within the clamping apparatus and the first jaw is in the closed position relative to the second jaw; and at least one wire bending head configured to traverse a path along the length of the wire, the at least one wire bending head further configured to bend the wire.

7. The wire bending apparatus of claim 6, the at least one support element further comprising two or more support rollers wherein at least one of the support rollers is supported by the second jaw, the support rollers positioned within the apparatus such that they are configured to clamp the round wire through tangential contact with the outside surface of the wire when the first jaw is in the closed position relative to the second jaw.

8. The wire bending apparatus of claim 6, further comprising a wire loading mechanism configured to position a wire between the first jaw and the second jaw when the first jaw is in the opened position relative to the second jaw.

9. The wire bending apparatus of claim 6, further comprising a drive mechanism coupled to the at least one drive roller, configured to rotate the at least one drive roller.

10. The wire bending apparatus of claim 6, further comprising a clamping actuator mechanically coupled to the first jaw and the second jaw and configured to drive the first jaw and the second jaw between the open position and the closed position.

11. A wire bending apparatus comprising:

a clamping apparatus configured to secure a wire relative to the wire bending apparatus, the clamping apparatus further comprising:

a first jaw and a second jaw configured to move relative to each other between an open position and a closed position;

at least one drive roller supported by the first jaw and configured to tangentially contact the wire on the outside surface of the wire when the first jaw and the second jaw are in the closed position, the at least one drive roller also configured to rotate the wire about an axis parallel to the length of the wire;

at least one support element configured to make tangential contact with the outside surface of the wire when the first jaw and the second jaw are in the closed position, the at least one support element positioned to make contact with the wire across the longitudinal axis of the wire when the wire is present within the clamping apparatus and the first jaw is in the closed position relative to the second jaw;

at least one wire bending head configured to traverse a path along the length of the wire, the at least one wire bending head further configured to bend the wire;

a cartridge body removably secured to the second jaw wherein at least one of the support rollers is supported by the cartridge body.

12. A method of forming a wire, the method comprising:

securing the wire within a clamping mechanism comprising a first jaw and a second jaw pivotally joined to one another through a fulcrum, by driving at least one of the first jaw and the second jaw to a closed position in which at least one support element contacts the wire across a longitudinal axis of the wire from at least one drive roller;

bending the wire at a first predetermined position along the length of the wire using a wire bending head configured to traverse a path along the length of the wire;

rotating the wire within the clamping mechanism through a predetermined angle of rotation, by rotating the at least one drive roller in contact with the wire on an outside surface of the wire;

bending the wire at a second predetermined position along the length of the wire using the wire bending head.

13. The method of forming a wire of claim 12, wherein the predetermined angle of rotation may exceed 360 degrees.

14. The method of forming a wire of claim 12, wherein the second predetermined position is closer to the clamping mechanism than the first predetermined position.

15. The method of forming a wire of claim 12, further comprising:

opening the clamping mechanism such that the wire may pass between the first jaw and the second jaw of the clamping mechanism;

loading the wire into the clamping mechanism.

16. A method of forming a wire, the method comprising:

securing a wire within a clamping mechanism comprising at least one drive roller configured to contact the wire at a point on the outside surface of the wire;

bending the wire at a first predetermined position along the length of the wire using a wire bending head configured to traverse a path along the length of the wire;

rotating the wire within the clamping mechanism through a predetermined angle of rotation, by rotating the at least one drive roller;

bending the wire at a second predetermined position along the length of the wire using the wire bending head;

replacing a first cartridge body comprising at least one support roller with a second cartridge body comprising at least one differently sized support roller, securing a second wire within the clamping mechanism; and bending the second wire at a position along the length of the second wire using the wire bending head.

* * * * *